US005797476A

United States Patent [19]

Jones et al.

[11] Patent Number: 5,797,476

[45] Date of Patent: Aug. 25, 1998

[54] DUAL DELIVERY COIN/TOKEN DISPENSER

[75] Inventors: Michael F. Jones, Mt. Vernon, N.H.; Paul O. Stump, Topsfield, Mass.

[73] Assignee: Telequip Corporation, Hollis, N.H.

[21] Appl. No.: 744,370

[22] Filed: Nov. 7, 1996

[51] Int. Cl.[6] ..... G07D 1/00

[52] U.S. Cl. ..... 194/346; 193/31 R

[58] Field of Search ..... 194/346; 221/252; 193/31 R, 31 A

[56] References Cited

U.S. PATENT DOCUMENTS

| | | | |
|---|---|---|---|
| 1,944,313 | 1/1934 | Brandt | 193/31 R |
| 1,998,602 | 4/1935 | Anderson | 193/31 R |
| 2,952,348 | 9/1960 | Buchholz et al. | 193/31 R |

FOREIGN PATENT DOCUMENTS

| | | | |
|---|---|---|---|
| 2133601 | 7/1984 | United Kingdom | 194/346 |

OTHER PUBLICATIONS

Telequip Corporation, Product Depiction.

Telequip Corporation, Transact Coin Dispenser with Cointrak, Product Literature.

Brandt, Inc., Model #559, Accuchange Coin Dispenser, Product Literature, 1988.

Brandt, Inc., Model #580, Cashier Coin Dispenser, Product Literature.

Brandt, Inc., Model #583, Remote Keyboard Dispenser, Product Depiction.

*Primary Examiner*—F. J. Bartuska

*Attorney, Agent, or Firm*—Banner & Witcoff Ltd.

[57] ABSTRACT

A dual delivery mechanism for a coin dispenser providing the ability to deliver coins or tokens to coin cups on both sides of a coin/token dispensing machine has a moveable ramp connected to a transfer lever. The position of the ramp is controlled by a double-acting solenoid that moves a single solenoid plunger connected to the transfer lever. The dual delivery mechanism is mounted in the coin dispenser chassis so that the ramp is positioned beneath the chute into which coins fall when they are ejected from the coin canister. The double-acting solenoid may be controlled by a separate PCB located in the coin canister chassis to which the main microcomputer of the coin dispenser transmits the signal to indicating which direction the coins should be dispensed. Upon receiving the signal, the PCB generates a pulse to the appropriate drive solenoid consisting of an initial short, high voltage part that initiates motion, followed by a longer, low voltage part that maintains ramp position during coin ejection. Energization of one of the sides of the double-acting solenoid causes the solenoid to retract, pulling the lever arm and pivoting the moveable ramp to the appropriate side.

14 Claims, 3 Drawing Sheets

DUAL DELIVERY COIN/TOKEN DISPENSER

FIELD OF THE INVENTION

The present invention relates to electromechanical devices and, in particular, to coin dispensing machines.

BACKGROUND

Coin and token dispensing machines typically consist of a body portion, or chassis, to which a separate coin/token canister or magazine is removably attached. A coin/token canister or magazine consists in its simplest form of a series of columns or chambers sized to fit the intended coins or tokens. The chassis has a ramp or chute down which the coins or tokens roll after ejection from the canister.

When a coin or token is ejected from the coin canister by an ejection mechanism, it typically falls a short way down a chute or deflector and then onto a ramp that guides the coin into a coin cup where it can be collected by the customer. Prior art coin dispensing machines all employ a ramp and/or chute with a fixed position and are consequently limited to dispensing coins to only one place on the machine, usually one of the two sides. This means that a prior art coin dispensing machine can only serve a single cashier or teller's window; otherwise there would be confusion as to which customer was intended to receive the change being delivered to the single coin cup.

Coin dispensing machines can be very bulky, consuming a fair amount of counter space. In addition, in many situations where coin or token dispensing machines are used, counter space is either very limited or needed for other purposes. For example, at a teller's window, room must be provided for such activities as check writing, check validation, cash counting and distribution, cashier's check generation, traveler's check processing, and coin counting and dispensing. At a point-of-sale, space must often be provided for many functions including check writing, cash receipt, counting, and dispensing, price read or key in, security device removal and disarming, price tag removal, purchase packaging, hanger or other display device removal and storage, and credit or debit card handling.

A great deal of space can be saved if one or more of these functions could be shared between two cashiers or two tellers. This is particularly useful for those functions which are very transient, consuming only a few seconds of the entire transaction time, with the space or device lying idle for the remainder of the transaction. The dispensing of paper bills is such a function, and the sharing of a dispenser for paper bills between two bank tellers is already fairly common. The coin dispensing function also meets this criterion, with the coin dispenser being activated to dispense coins only at the very end of the transaction, the rest of the time remaining idle.

If the coin dispenser could be shared with another cashier or teller, twice the use could be made of the same device and space, freeing up space for other functions. In addition, this would mean that the retail establishment or bank would have fewer machines to buy, maintain, fill, and service. What has been needed, therefore, is a way to allow coin dispensing machines to be shared between two control points while still keeping individual transactions separately identifiable.

OBJECTS OF THE INVENTION

Accordingly, a primary object of the present invention is to provide a coin dispensing machine with the capability to dispense coins to either side.

In particular, an object of the present invention is to allow one coin dispensing machine to service two point-of-sale checkout lines or teller's windows.

A further particular object of this invention is to conserve counter space at a point of sale or teller's window by use of only one coin dispenser for every two registers or windows.

SUMMARY

A dual delivery mechanism for a coin dispenser provides the ability to deliver coins or tokens to either or both sides of a coin/token dispensing machine. In one aspect of the invention, the coin dispenser chassis has two coin cups on opposite sides. The dual delivery mechanism has a moveable ramp connected to a transfer lever. The position of the ramp is controlled by a double-acting solenoid that controls the back-and-forth movement of a single solenoid plunger connected to the transfer lever. The dual delivery mechanism is mounted in the chassis so that the ramp is positioned beneath the chute into which coins fall when they are ejected from the coin canister.

In another aspect of the invention, the double-acting solenoid is controlled by the ramp drive PCB located in the coin canister chassis. When the right solenoid in die double-acting solenoid is energized, the ramp pivots so that its right end dips and the coins or tokens ejected from the coin canister are delivered to the right coin cup. Similarly, when the left solenoid in the double-acting solenoid is energized, the ramp pivots so that the left end of the ramp drops and the coins or tokens ejected from the canister are delivered to the left coin cup. While the preferred embodiment uses a double-acting solenoid to control the movement of the ramp, any other drive method known in the art would also be satisfactory, particularly either an AC or DC motor connected to a drive arm and responding to left and right commands.

In a further aspect of the invention, the main microcomputer of the coin dispenser transmits a signal to the ramp drive PCB indicating which direction the coins should be dispensed. The Left or Right determination can be generated directly by the point-of-sale (POS) terminal, or can be made by the main microprocessor based on whether the delivery request comes from the left or right terminal. This function may alternatively be performed by an auxiliary interface board.

Upon receiving a signal indicating right or left delivery, the ramp drive PCB generates a pulse to the appropriate drive solenoid. The pulse consists of an initial short, high voltage part that initiates motion and is followed by a longer, low voltage part that maintains ramp position during coin ejection. The solenoid retracts, pulling the lever arm that is attached to the moveable ramp which pivots, creating a sloping surface down which the coins roll. In a further aspect of the invention, the solenoid drive is preferentially a bi-level drive, designed to provide a more even movement that minimizes bounce at the end of ramp movement.

DETAILED DESCRIPTION OF THE PREFERRED EMBODIMENT

A dual delivery mechanism for a coin dispenser provides the ability to deliver coins or tokens to either side of a coin/token dispensing machine. This allows a single coin dispenser to take the place of two prior art systems in applications where two checkout lines or two teller's windows are being serviced.

Figure 1:
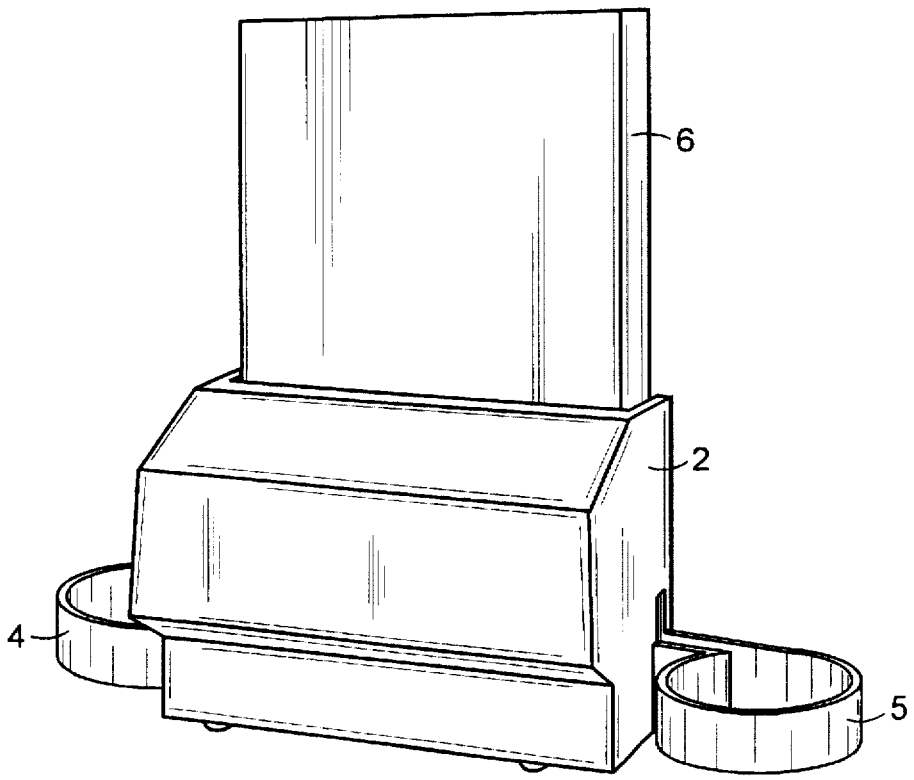
FIG. 1 is a front view of an embodiment of a coin dispensing machine having the dual delivery mechanism of the present invention.

In FIG. 1, a front view of a coin dispenser having the dual delivery mechanism of the present invention shows the chassis 2 with two coin cups 4 and 5, the first coin cup 4 being located on the right hand side of the chassis 2 and the second coin cup 5 being located on the left-hand side. The coin canister or magazine 6 is inserted in the top of the chassis 2 in a position where it does not interfere with the operation or use of the coin cups 4 and 5. Inside the front face of the chassis 2 is the dual delivery mechanism that selectively delivers the coins or tokens to one of the two coin cups 4 and 5.

Figure 2A:
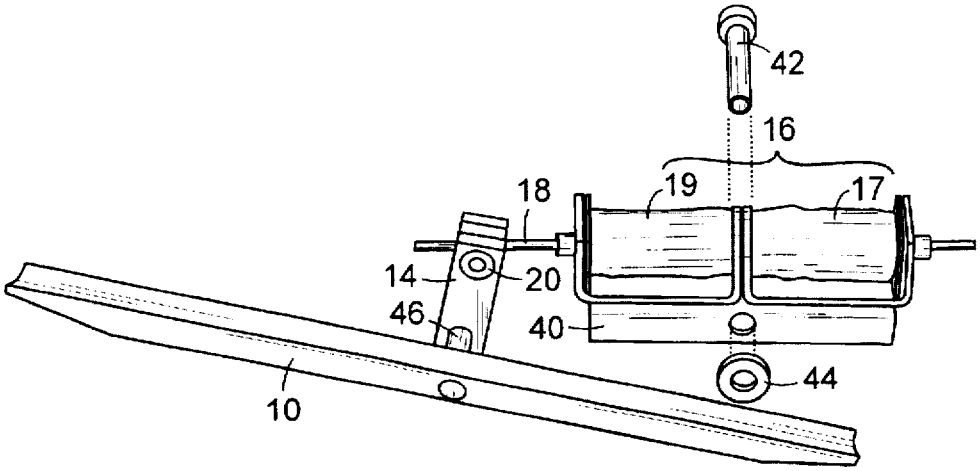
FIG. 2A is a partially exploded front view of one embodiment of the dual delivery ramp mechanism of the present invention.
Figure 2B:
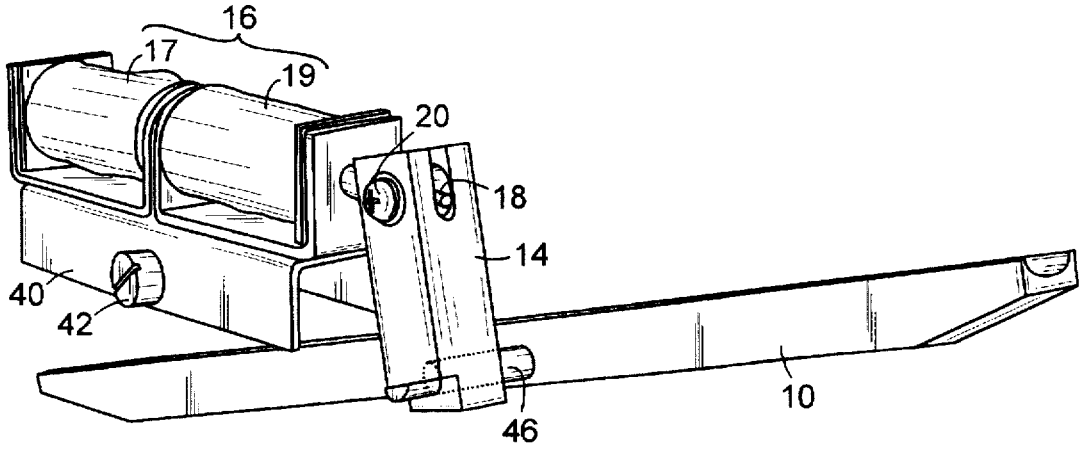
FIG. 2B is a rear view of the embodiment of FIG. 2A.

FIGS. 2A and 2B show a front and rear view respectively of the dual delivery mechanism of the present invention. As shown in FIGS. 2A and 2B, the dual delivery mechanism for a coin dispenser has a moveable ramp 10 connected by pin 46 to a transfer lever 14. If desired, the pin 46 may be connected to the transfer lever 14 via a transfer bushing for stability and force distribution. The position of the ramp 10 is controlled by a double-acting solenoid 16 constructed from two linear solenoids, a right solenoid 17 and a left solenoid 19. The double-acting solenoid 16 controls the back-and-forth movement of the single solenoid plunger 18, which is connected via a transfer drive nut 20 to the transfer lever 14, and which controls the movement of the ramp 10.

The double-acting solenoid 16 is mounted on a solenoid cradle 40 for attachment to the inside of the coin dispenser chassis 2. The solenoid cradle 40 is held to the inside of the coin dispenser chassis by the solenoid cradle pin 42 and washer 44. The dual delivery mechanism is positioned in the chassis 2 so that the ramp 10 is positioned beneath the chute into which coins fall when they are ejected from the coin canister 6.

Figure 3:
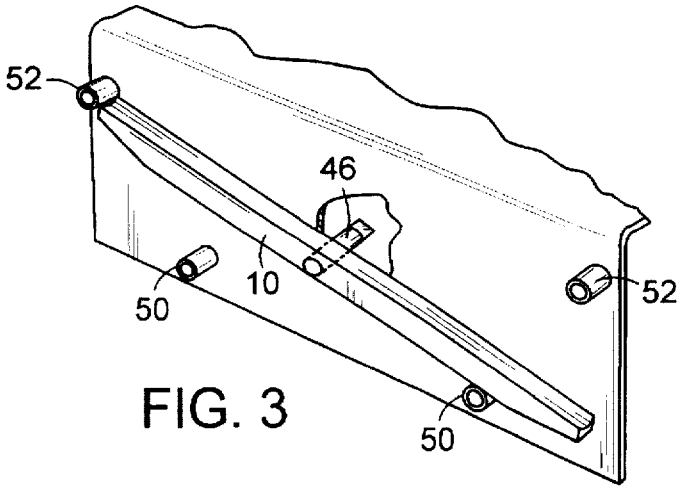
FIG. 3 is a rear view of the ramp of FIGS. 2A and 2B.

As shown in FIG. 3, the ramp 10 has an attached pin 46. In the preferred embodiment, the ramp 10 is connected to the transfer lever 14 by the attached pin 46 through a transfer bushing and the wall in the coin canister chassis upon which the solenoid cradle 40 is mounted. The pin 46 is used in the preferred embodiment of the invention both to connect the ramp 10 to the transfer lever 14 and to help maintain the relationship of the ramp 10 to the coin chute during coin ejection.

The double-acting solenoid 16 is controlled by a signal from the ramp drive PCB located in the coin canister chassis 2. When the right solenoid 17 is energized, the ramp 10 pivots so that the right end dips and the coins or tokens ejected from the coin canister 6 are delivered to the right coin cup 4. Similarly, when the left solenoid 19 is energized, the ramp 10 pivots so that the left end of the ramp drops and the coins or tokens ejected from the canister 6 are delivered to the left coin cup 5. As shown in FIG. 3, the ramp 10 is constrained in its movement by two lower stops 50, one on either side of the ramp, and two optional upper stops 52.

The double-acting solenoid 16 acts to pull the solenoid plunger 18 in one of two directions, depending on which of the solenoids 17 and 19 is energized. When one of the solenoids 17 and 19 is energized, the solenoid plunger 18 becomes magnetized and the mutual action of the field in the solenoid on the poles created on the plunger 18 causes the plunger 18 to move within the solenoid 16. This movement is then transferred via the transfer lever 14 to the ramp 10.

While the preferred embodiment uses a double-acting solenoid in an open-loop configuration to control the movement of the ramp 10, any other drive method known in the art would also be satisfactory. In particular, either an AC or DC motor connected to a drive arm and responding to left and right commands could be substituted for the double-acting solenoid 16 and plunger 18. An advantage of using the double-acting solenoid in an open-loop configuration is that no feedback is needed to ascertain the current position of the ramp before the drive signals are given or during ramp movement, as would be required with an electric motor or a closed loop solenoid design. There is a trade off with this, however, in that more effort must be made to precisely understand and control the ramp movement from the outset, since additional adjustments cannot be made while the ramp is in motion.

In the preferred embodiment, the circuitry for controlling the dual delivery mechanism is localized on a single PCB that is supplied as an optional plug-in to the standard coin dispenser circuit board. Use of a "daughter" board allows the dual delivery mechanism to be included as an option in a coin dispensing system without any increased manufacturing costs to a system sold without mechanism.

Figure 4:
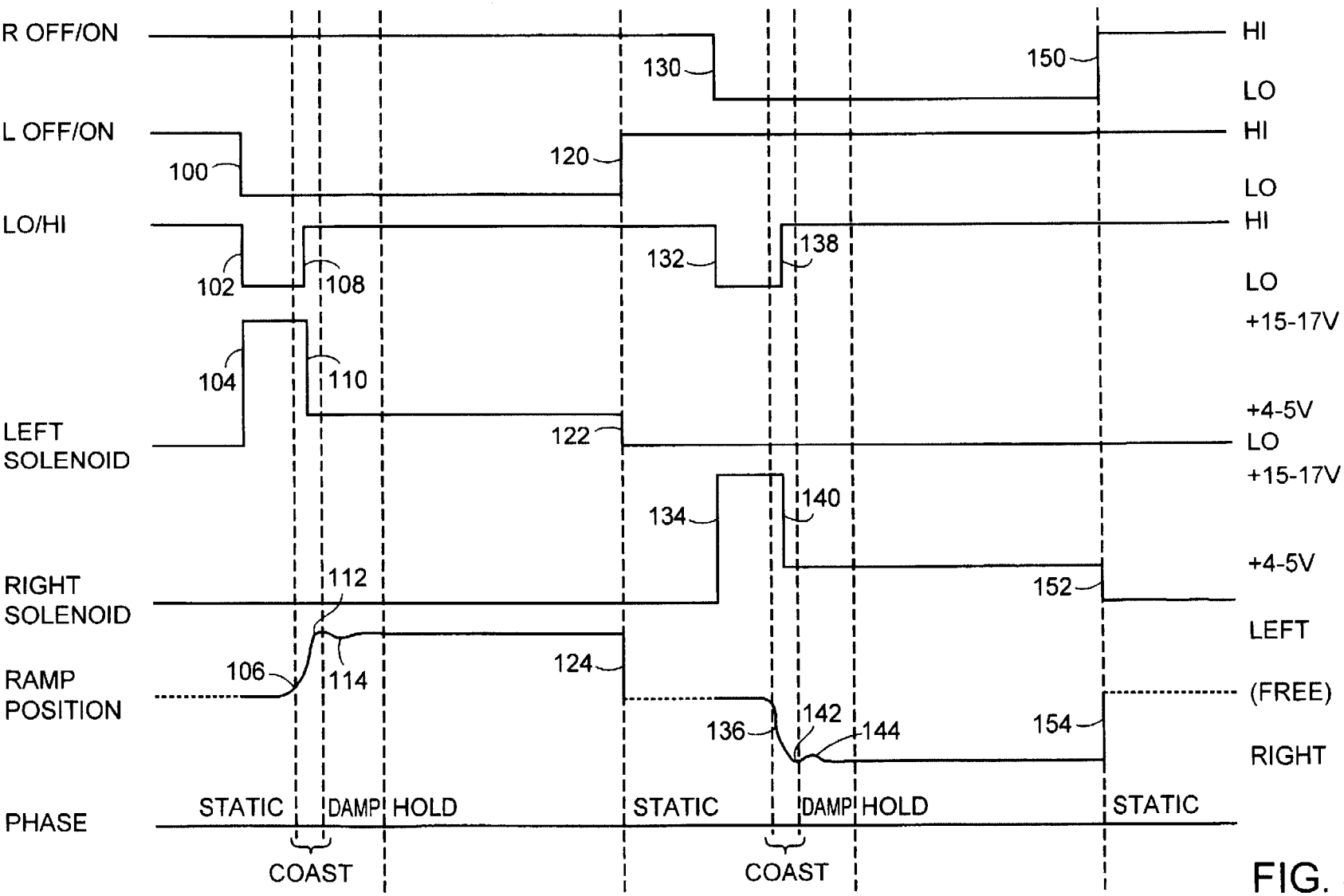
FIG. 4 is a timing diagram for the operation of an embodiment of a PCB for controlling the dual delivery mechanism of the present invention.

A timing diagram for the operation of a preferred embodiment of the ramp drive PCB is shown in FIG. 4. This embodiment is an open-loop configuration, and the precise time intervals and voltages given are strictly constrained by the power and timing requirements of the particular coin dispenser with which it was designed to function. The actual circuitry and operation of a given ramp drive PCB will therefore generally vary according to both the drive mechanism selected and constraints imposed by factors external to the invention. The creation of the basic circuitry needed to generate the necessary voltages and pulses on a PCB while meeting a specific set of external constraints is well within the ability of one skilled in the art.

As seen in FIG. 4, the preferred embodiment of the ramp drive PCB accepts three inputs LO/HI, R OFF/ON, and L OFF/ON. It produces two outputs, signals applied to the left solenoid 19 and right solenoid 17. Upon receiving a signal indicating right or left delivery, the ramp drive PCB generates a pulse to the appropriate drive solenoid 17 or 19. The pulse consists of an initial short, high voltage part that initiates motion and is followed by a longer, low voltage part that maintains position of the ramp 10 during coin ejection. The latter voltage is necessary mainly to counteract the force applied to the ramp by the coins as they drop onto it. At the high pulse, the selected solenoid 17 or 19 retracts, pulling the transfer lever 14 that is attached to the moveable ramp 10. The ramp 10 then rotates, creating the sloping surface down which the coins roll once they have been ejected from the coin canister.

In FIG. 4, the system is originally in the STATIC state, all three inputs, LO/HI, R OFF/ON, and L OFF/ON being HI and the two output signals to the two solenoids being LO. The ramp 10 is in a free state, being constrained to neither side and moveable by hand if desired. A left ramp delivery signal arrives from the main microcomputer when L OFF/ON and LO/HI are pulled LO 100, 102. The LO on LO/HI causes a high voltage pulse 104 to be sent to the left solenoid 19, energizing it and causing the ramp position to drop toward the left 106. In the preferred embodiment, the high voltage pulse 104 is about +15–17 V and lasts about 100 ms.

Initially, the ramp moves slowly while static friction and solenoid mechanism losses are being overcome. After the static forces are overcome, the ramp begins moving quickly and the system enters the COAST phase. The COAST phase requires little or no energy. After 100 ms, LO/HI is pulled HI 108 by the main microprocessor, ending the high voltage pulse to the left solenoid, dropping it to a medium level pulse 110 that in the preferred embodiment is +4–5 V. The ramp reaches 112 the mechanical stop 50 on the lower left and the system enters the DAMP phase.

In the DAMP phase, the voltage continues to be applied to the left solenoid at a medium level, counteracting any bounce 114 that might be experienced by the ramp 10 when it contacts the lower stop 50 and forcing the ramp 10 against the stop. After all reflective bounce has been controlled, the system enters the HOLD phase, with the medium level voltage continually applied to the left solenoid to prevent the force of the coins being ejected from the coin canister and hitting the ramp 10 from moving the ramp.

When all coins have been ejected, L OFF/ON is returned HI 120, and the signal to the left solenoid drops LO 122. Power to the ramp 10 is now turned off while awaiting the next transaction, so the ramp re-enters the free state 124 and the system returns to the STATIC phase.

Similarly delivery to the right coin cup is begun when the main microcomputer sends R OFF/ON and LO/HI LO 130, 132, causing a high voltage pulse 134 on the right solenoid 17. The ramp 10 begins to move right 136, overcoming the static forces and entering the COAST phase. LO/HI is returned HI 138, ending the high voltage pulse to the right solenoid 17, dropping it to a steady applied medium level voltage 140. The ramp 10 contacts 142 the lower right stop 50, and any bounce 144 is counteracted by the medium level voltage being applied to the right solenoid 17. Once all the coins have been ejected from the coin canister onto the ramp, the main microprocessor returns R OFF/ON HI 150 and the signal to the right solenoid goes LO 152. The ramp 10 again enters the free state 154.

In the preferred embodiment, the solenoid drive is a bi-level drive. Whereas most solenoids function in the manner of a switch, the bi-level drive is designed to provide a more even movement that can minimize bounce at the end of ramp movement. The amplifier used in the drive circuit is both a class A and a class C amplifier, and is switched between the two modes to provide two different voltage levels. This allows the electronics to control the two voltage levels of the signal supplied to the drive solenoids.

If a bi-level configuration is not available or is disfavored due to certain external constraints, an alternative would be to employ pulse width modulation. A drive using pulse width modulation would employ the high voltage available to create the initial pulse, and then would cycle the voltage between LO and HI to create, as an average, a medium level voltage for the purpose of holding the ramp in place during coin ejection.

Alternatively, mechanical jar at the end of the stroke can be at least partially prevented by leaving the end of the solenoid open. The plunger then comes to equilibrium when its middle is at the middle of the winding, providing a magnetic cushion effect. This is translated to the ramp movement and reduces the bounce cause by the end of the plunger stroke. This would not address the need to hold the ramp steady during coin ejection, however, some type of medium voltage signal would possibly still be required.

Other drive alternatives would be to employ an electric motor with position feedback or a solenoid in a closed loop design providing position feedback. These alternatives require electronics to monitor the position of the ramp during and after movement, but allow the actual drive parameters to be far less constrained since it is not necessary to develop an optimum voltage wave form in advance. As previously discussed, the selection of drive would be governed largely by constraints imposed by the coin dispenser used, rather than needs of the dual delivery mechanism.

A system employing two point-of-sale (POS) terminals and one coin dispenser can be configured in several ways. If a single cash dispenser is also being used, the POS terminals can both communicate with the cash dispenser which then signals the amount and type of coins needed to the coin dispenser. In such a case, the cash dispenser will need to tell the coin dispenser which direction to send the coins. This configuration has the advantage that the coin dispenser does not need to have the ability to determine this for itself. Alternatively, the POS terminals may be connected directly to the coin dispenser, in which case the coin dispenser must have the ability to determine which direction to pivot the ramp, unless the POS terminals themselves are designed and configured to send such information.

In the preferred embodiment, the main microcomputer of the coin dispenser employs an asynchronous ASCII serial protocol that uses a capital L or R at the end of the character string to indicate which direction the coins should be dispensed, "L" being left and "R" being right. The last "L" or "R" received before a coin ejection signal controls which side the ramp is sent to during coin ejection. The system may also optionally be configured to simply alternate the ramp position for each dispense cycle.

The L or R can be initially generated directly by the POS terminal, or can be added by the main microprocessor based on whether the delivery request comes from the left or right terminal as determined by which RS-232 port the terminal is connected to. This latter function may also be performed by an auxiliary interface board if desired, in which case the auxiliary interface board receives the request from the POS terminal, determines based on the requesting terminal location whether the coin delivery should be to the right or left, and adds the appropriate character to the end of the string being sent to the main microprocessor. In the preferred embodiment the auxiliary interface board would be an optional plug-in for the main coin dispenser board.

While the ability to deliver coins to either or both of two coin cups is a feature of this, invention, use of the invention to deliver coins to one cup only, for example, in situations where a second cashier's line is anticipated but not yet installed, is contemplated by the inventors and therefore within the scope of the invention. Other modifications and substitutions by one of ordinary skill in the art are also considered to be within the scope of the present invention, which is not to be limited except by the claims which follow.

What is claimed is:

1. A dual delivery mechanism for dispensing to either side of a dispenser of coin-like objects, comprising, in combination:

a transfer lever means;

a pivotable ramp means having left and right ends, said ramp means being pivotably attached to said transfer lever means said ramp means being controllable via said transfer lever means so as to pivot either said left or said right end of said ramp means downwards;

a drive mechanism, said drive mechanism being attached to said transfer lever means, said drive mechanism further being controllable to pivot said ramp means via said transfer lever means; and drive mechanism control means, said drive mechanism control means operating to control the actions of said drive mechanism, said drive mechanism control means comprising, in combination:

means for accepting an activation signal from said dispenser;

means for actively determining from the content of said activation signal a specified end of said ramp means to be pivoted downwards;

means for producing a high voltage pulse for causing said drive means to move said transfer lever in such a manner as to begin the pivoting of said specified end of said ramp means downwards, said high voltage pulse lasting at least until said ramp means has actually begun to pivot;

means for reducing said high voltage pulse to a medium voltage after said ramp means has begun to pivot, allowing said ramp means to coast freely in the desired direction of pivoting;

means for maintaining application of said medium voltage level to said drive mechanism until said ramp means has pivoted fully and ceased any bouncing, and one of said coin-like objects has been dispensed; and means for returning to an initial LO voltage state in readiness for a next activation signal from said dispenser.

2. The dual delivery mechanism of claim 1, further comprising a transfer bushing means, said transfer bushing means being pivotably attached between said ramp means and said transfer lever means.

3. The dual delivery mechanism of claim 1, further including coin cups positioned below either end of said ramp means.

4. The dual delivery mechanism of claim 1, wherein said drive mechanism is a double-acting solenoid having a solenoid plunger means, said double acting solenoid being attached to said transfer lever means by said solenoid plunger.

5. The dual delivery mechanism of claim 1, wherein said drive mechanism is an electric motor.

6. The dual delivery mechanism of claim 1, further comprising at least one mechanical stop to halt the motion of said pivotable ramp means at a desired stopping point.

7. The dual delivery mechanism of claim 4, wherein said double-acting solenoid is driven at two different voltage levels so as to move and then subsequently hold said ramp means.

8. A means for delivering coin-like objects to either side of a dispensing mechanism, comprising, in combination:

a ramp means, said ramp means having left and right ends;

a means for pivoting said ramp means, said means for pivoting said ramp means being pivotably attached to said ramp means and controlled by said dispensing mechanism; and means for controlling said means for pivoting, said means for controlling comprising, in combination:

means for accepting an activation signal from said dispensing mechanism;

means for actively determining from the content of said activation signal a specified end of said ramp means to be pivoted downwards;

means for producing a high voltage pulse for causing said means for pivoting to begin the pivoting of said specified end of said ramp means downwards, said high voltage pulse lasting at least until said ramp means has actually begun to pivot;

means for reducing said high voltage pulse to a medium voltage after said ramp means has begun to pivot, allowing said ramp means to coast freely in the desired direction of pivoting;

means for maintaining application of said medium voltage level to said means for pivoting until said ramp means has pivoted fully and ceased any bouncing, and one of said coin-like objects has been successfully dispensed; and means for returning to an initial voltage state in readiness for a next activation signal from said dispensing mechanism.

9. The means for delivering coin-like objects of claim 8, wherein said means for pivoting said ramp means is a solenoid means.

10. The means for delivering coin-like objects of claim 9, wherein said ramp means is connected to said means for pivoting said ramp means by a lever means, said lever means being pivotably attached between said solenoid means and said ramp means.

11. The means for delivering coin-like objects of claim 9, wherein said solenoid means is a double-acting solenoid.

12. The means for delivering coin-like objects of claim 8, wherein said means for pivoting said ramp means is an electric motor means.

13. The means for delivering coin-like objects of claim 12, wherein said ramp means is connected to said means for pivoting said ramp means by a lever means, said lever means being pivotably attached between said electric motor means and said ramp means.

14. A method for delivery of coin-like objects to both sides of a dispenser of coin-like objects, comprising in combination the steps of:

attaching a pivotable ramp means having a drive mechanism to said dispenser of coin-like objects;

signaling to said drive mechanism, when said coin-like objects are to be dispensed, which of said sides said coin-like objects should be dispensed to;

accepting said signal from said dispenser;

actively determining from the content of said signal a specified end of said ramp means to be pivoted downwards;

producing a high voltage pulse for causing said drive mechanism to begin the pivoting of said specified end of said ramp means downwards, said high voltage pulse lasting at least until said ramp means has actually begun to pivot;

driving said pivotable ramp means with said drive mechanism to drop the end of said pivotable ramp means corresponding to the side of dispensing;

reducing said high voltage pulse to a medium voltage after said ramp means has begun to pivot, allowing said ramp means to coast freely in the desired direction of pivoting;

maintaining application of said medium voltage level to said drive mechanism until said ramp means has pivoted fully and ceased any bouncing, and one of said coin-like objects has been successfully dispensed;

maintaining said ramp means in position during the ejection of said coin-like objects from said dispenser; and returning to an initial state in readiness for a next signal from said dispenser.

* * * * *